US005150533A

United States Patent [19]

Farling et al.

[11] Patent Number: 5,150,533

[45] Date of Patent: Sep. 29, 1992

[54] SINGLE UNIT APPARATUS FOR CHILLING, DRYING AND INCUBATING PHOTOGRAPHIC EMULSIONS

[75] Inventors: Duane J. Farling, Webster; Gary A. Smith, Greece, both of N.Y.

[73] Assignee: Eastman Kodak Company, Rochester, N.Y.

[21] Appl. No.: 823,919

[22] Filed: Jan. 22, 1992

[51] Int. Cl.[5] ..... F26B 19/00

[52] U.S. Cl. ..... 34/62; 34/70

[58] Field of Search ..... 34/13, 14, 16, 17, 18, 34/60, 62, 68, 69, 70, 71, 143, 144, 145, 146, 39; 354/297, 299

[56] References Cited

U.S. PATENT DOCUMENTS

| | | | |
|---|---|---|---|
| 767,202 | 8/1904 | Bonneau | 34/145 |
| 3,638,605 | 2/1972 | Grandgirard | 118/50.1 |
| 3,660,910 | 5/1972 | Evans et al. | 34/60 |
| 4,497,121 | 2/1985 | Choinski | 34/23 |
| 4,567,673 | 2/1986 | Bohnensieker | 34/23 |

FOREIGN PATENT DOCUMENTS

| | | | |
|---|---|---|---|
| 1140692 | 12/1956 | France | 34/145 |

*Primary Examiner*—Henry A. Bennet
*Attorney, Agent, or Firm*—Heslin & Rothenberg

[57] ABSTRACT

An apparatus for chilling, drying and incubating a photographic emulsion in an integrated process at a single locus includes a chamber, a platen and means for chilling and heating the platen and providing a flow of air of controlled temperature and humidity over the photographic emulsion.

5 Claims, 2 Drawing Sheets

SINGLE UNIT APPARATUS FOR CHILLING, DRYING AND INCUBATING PHOTOGRAPHIC EMULSIONS

CROSS REFERENCE TO RELATED APPLICATIONS

This application contains subject matter in common with U.S. applications entitled "Microwave-Heated Film Processing Apparatus" and "Apparatus For Testing Photographic Emulsions" filed on even date herewith.

BACKGROUND OF THE INVENTION

1. Field of the Invention

The invention relates to an apparatus for chilling, drying and incubating a photographic emulsion in an integrated process at a single locus.

2. Background Art

The commercial production of photographic film involves the preparation of very large batches, on the order of 1500 L, of chemically complex photographic emulsions whose batch-to-batch variation in photographic response must be kept to a minimum. This necessitates the testing of each batch. Additionally, the research and development of a new photographic emulsion requires testing of varying emulsions under various conditions. In both cases emulsions have traditionally been tested by actually running a portion of the emulsion through commercial scale coating, chilling, drying and incubating machinery. This approach is very time-consuming, wastes large amounts of material, yields data slowly and is almost completely inflexible to fundamental changes in the process. A more compact, flexible and economic apparatus is needed.

The art provides some examples of apparatus that dry and heat treat workpieces. U.S. Pat. No. 3,638,605 (Grandgirard) discloses an apparatus for lacquering metallized boards wherein, in a dustproof enclosure each board is first dehydrated by heating, lowered vertically into a tank of lacquer, moved through the lacquer, raised vertically from the tank, and passed through a drying chamber. The drying chamber includes a lacquer setting chamber having a hot air feed therein and surmounted thereon a drying passageway including radiant and convection-type heaters.

U.S. Pat. No. 3,660,910 (Evans et al.) discloses an apparatus for heating and drying chilled, filled containers such as bottles and cans. The apparatus comprises an enclosed housing with upper and lower compartments. Upper compartment has first, second, and third heat zones between loading and unloading zones. A screen-type conveyor moves containers successively from the loading zone, through the heat zones, to the unloading zone. The containers are successively heated by: (a) overhead warm water spray in the first heat zone; (b) overhead hot water spray in the second heat zone; and (c) a combination of overhead and underneath hot water sprays in the third heat zone.

U.S. Pat. No. 4,567,673 (Bohnensieker) discloses an apparatus for heat-drying of webs. The apparatus comprises a closed housing divided into separate chambers within which the web is first subjected to hot air at about 300° C., then heated by heated rollers at about 230° C., after which it is cooled by a contact process in a third step.

More recently, an apparatus that can accommodate smaller lengths of web coated with emulsion has been described. U.S. Pat. No. 4,497,121 (Choinski) discloses an apparatus for simulating a process carried out on a moving web in which the web is held stationary while movement through a sequence of processing zones is simulated by means for rapidly changing the process conditions to which the web is exposed. Means are provided for stopping a coated length of web in the chill zone simulator, where the coated web is chilled by direct contact with a refrigerated chill plate. Alternatively, or in addition, the web can be raised off the chill plate and exposed to refrigerated air for a predetermined time, again while the web is stationary. The chilled web is then rapidly advanced into a drying zone simulator, where the web is again stopped. Sequential changes of drying air under selected conditions are each moved into the drying zone very rapidly, and maintained at a selected flow rate for a preselected interval.

All four of the references disclose apparatus and processes wherein the web or workpiece is subjected to heating and, in two references, chilling. In all four, the workpiece is moved and the treatment conditions are applied in different loci. Such systems are suited to large scale, repetitive operations, but are undesirable for small scale processing or testing where space and process flexibility are significant considerations. There is thus a need for a compact apparatus that can chill, dry and incubate photographic emulsions under varying sets of conditions with minimal time loss accruing from changing the conditions. There is a further need for an apparatus that can chill, dry and incubate an emulsion on a web without advancing the web, thereby reducing the space requirements as well as the transport and control requirements. The combination of chilling, drying and incubating will hereinafter be referred to as "curing."

SUMMARY OF THE INVENTION

It is an object of the present invention to provide a small, versatile apparatus for curing a variety of emulsions under readily modified conditions.

It is a further object of the invention to provide a single apparatus that can perform all of the steps of curing a photographic emulsion without moving the emulsion.

These objects are achieved by an apparatus that comprises:

(a) a single chamber having walls, a top integral therewith and a floor, discontinuous with at least two opposite walls. The chamber has provision for ingress and egress of an airflow. The floor of the chamber is in the form of:

(b) a platen disposed so as to provide a channel for a photographic emulsion-coated web interposed between the upper surface of the platen and the bottom edge of the walls;

(c) means for heating and cooling the platen. Preferably the means is a passage formed in the body of the platen through which a heat transfer fluid, preferably water, may be passed;

(d) means for urging the photographic emulsion-coated web into substantially uniform contact with the platen. The means for urging the web may be an air pressure differential between the emulsion-coated surface and the uncoated surface of the web, or preferably it may be a parallel pair of urging members attached to pneumatic cylinders mounted on opposite walls of the chamber at points such that when the pneumatic cylinders are activated, the members are displaced into contact with the web and the web is urged against the platen at opposite ends of the longer dimension of the platen. The platen surface in this case is planar across its shorter dimension and is an arc of a cylinder across its longer dimension;

(e) means for delivering air of predetermined temperature, humidity and flow rate into the chamber; and (f) controlling means for regulating the temperature of the platen and for regulating the delivery of air of predetermined temperature, humidity, and flow rate.

BRIEF DESCRIPTION OF THE DRAWINGS

These and other objects, features and advantages of the invention will be more readily understood from the following detailed description when read in conjunction with the accompanying drawings, in which.

DESCRIPTION OF PREFERRED EMBODIMENTS

Figure 1:
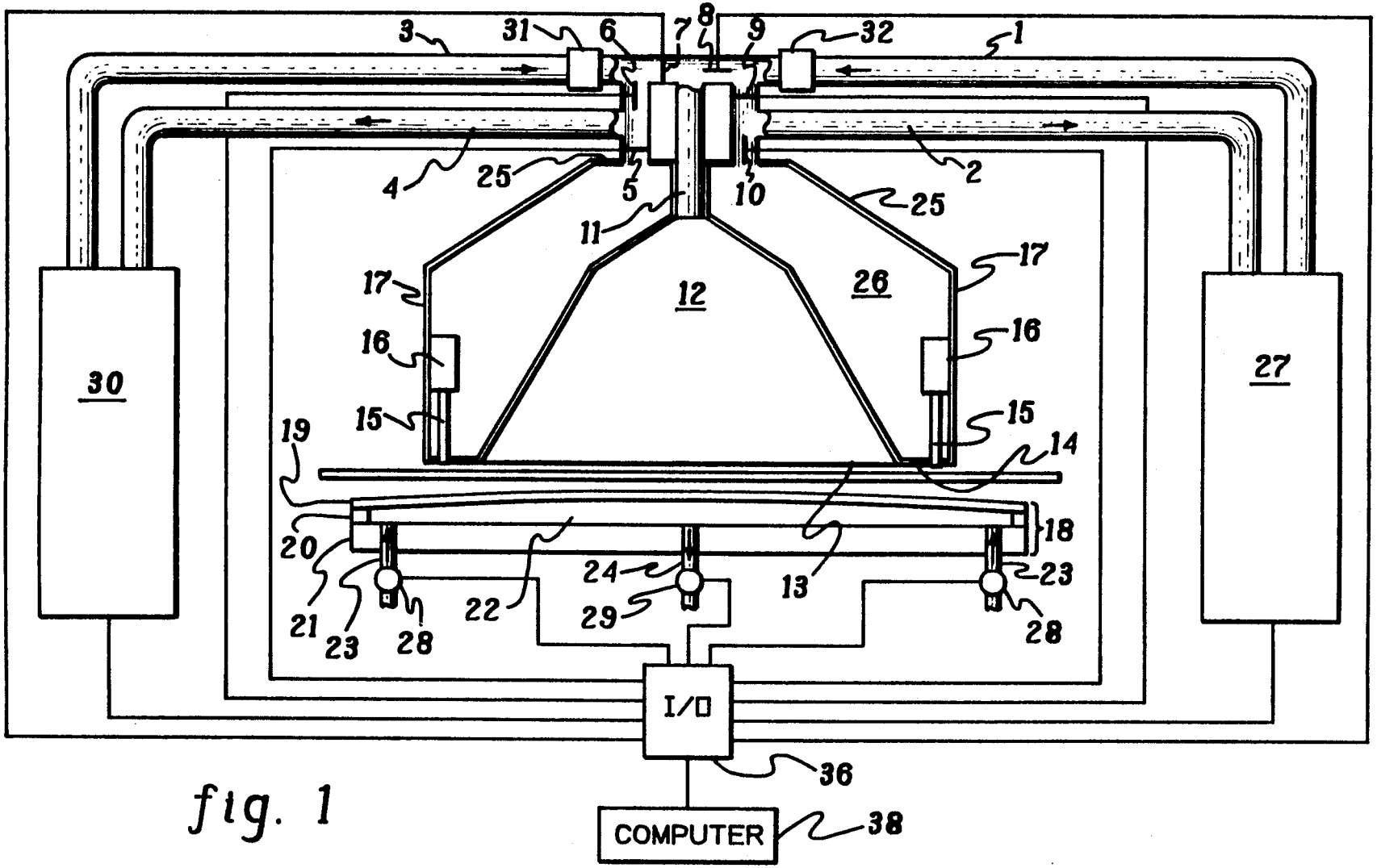
FIG. 1 is a schematic side view of an apparatus according to the invention.
Figure 2:
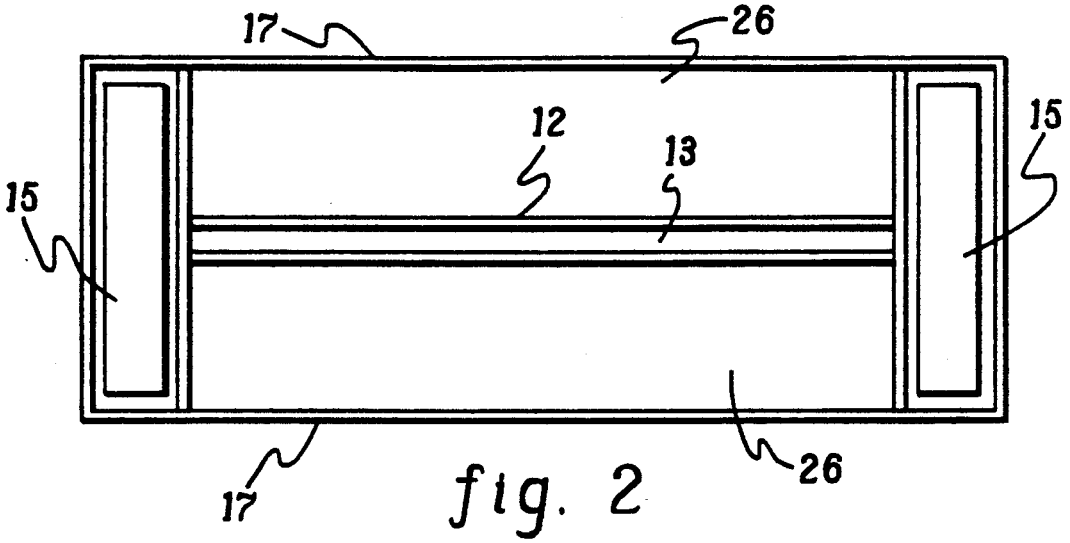
FIG. 2 is a schematic view of the bottom of the curing chamber showing the air delivery and return orifices.
Figure 3:
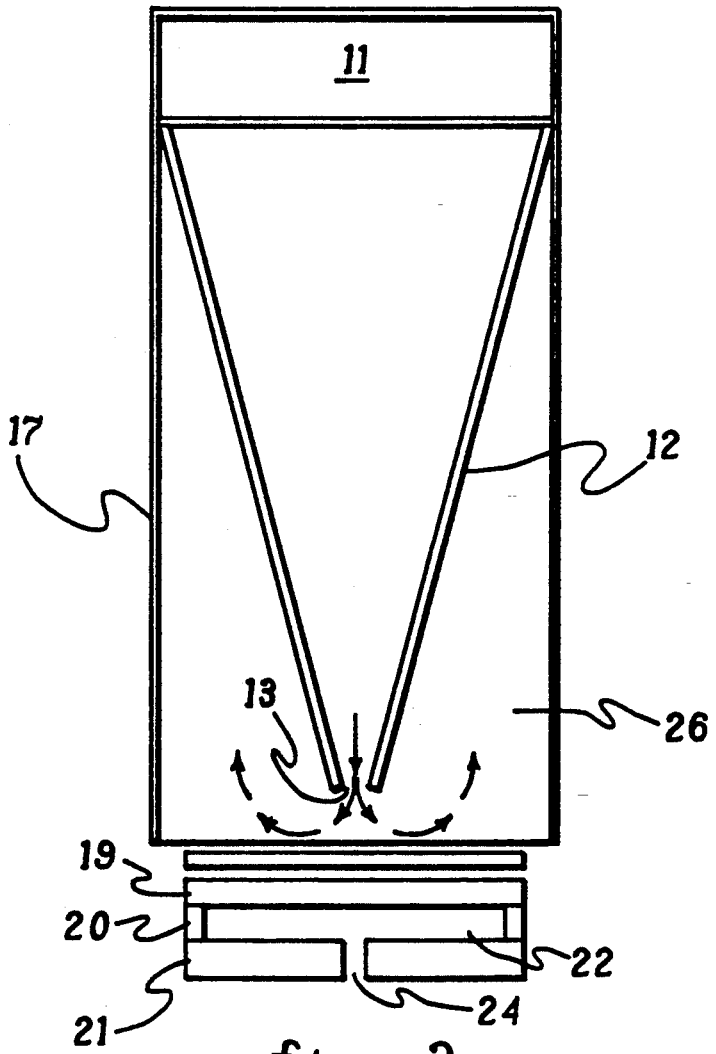
FIG. 3 is a schematic view of a section through the apparatus perpendicular to that of FIG. 1.

FIG. 1 shows a single chamber having walls 17 an integral top 25 and a floor formed by a platen 18. A web coated with a photographic emulsion passes along the underside of the chamber walls 17 and above the platen 18. The terms length, width and height will be defined from the standpoint of the emulsion. Thus, in FIG. 1 height is represented vertically, length horizontally and width along an axis perpendicular to the FIGURE. The chamber is at least as wide as the width of the emulsion; its length is not critical, but is usually from 10 to about 200 cm. In a particular embodiment the platen is 7 cm wide by 76 cm long and the chamber is of corresponding dimensions.

In operation, the web, at the start of the process, passes over the platen 18 but is not in contact with the platen 18 or the chamber walls 17. Chilled heat exchanging fluid, preferably water, of a temperature appropriate to set the gel in the emulsion of interest, is passed through a pair of orifices 23 formed in a platen support block 21 into a cavity 22 formed by the platen face plate 19, a gasket 20 and the support block 21. The heat exchange fluid is led out of the cavity through a central orifice 24. The platen face plate 19 may be constructed of any material that is thermally conductive and inert to the environment to which it will be exposed. The surface of the platen face plate is as smooth as possible for optimum heat transfer and is slightly arched in the longer dimension of the web so that contact with the web will be uniform when the web is held against the ends of the platen. The platen face plate 19 is thick enough to provide support for the web over its entire surface but no thicker than necessitated by mechanical requirements so as to minimize thermal inertia. It has been found that 1.27 mm stainless steel or preferably copper plated on its contact surface with chromium provides a suitable platen face plate. The gasket 20 is, in the preferred embodiment, about 13 mm thick and of any resilient water-resistant material. The plate support block 21 is preferably made of plastic or similar inert, mechanically stable, insulating material.

When the platen has reached a prescribed temperature, a pair of pneumatic cylinders 16 are activated and the urging members 15 are displaced downward against the surface of the web. The urging members are preferably of substantially the same or slightly greater width than the width of the platen. The movement of the urging members forces the web against the platen face plate 19. This configuration is maintained until the gel has set according to a prescribed combination of time and temperature appropriate to the specific emulsion being cured. An alternative to the preferred urging members 15 is to provide a vacuum to the surface of the platen as described, for example, in U.S. Pat. Nos. 3,149,550 and 3,744,394.

When the gel has set, dampers 8, 10 and 6 are opened; dampers 9, 5 and 7 are closed. Drying air is led into the chamber through duct 1 past damper 8 to a distributing manifold 12. Most efficient distribution of the drying air is achieved when the cross-sectional area of the orifice 13 on the face of the distribution manifold 12 is smaller than the cross-sectional area of the duct 1. The air passes laterally across the width of the emulsion and returns via a return manifold 26 formed by outer walls 17 and inner manifold 12 past damper 10 to return duct 2.

At an appropriate time in the cycle, the heat transfer fluid which has been cooling the platen 18 is switched to provide heating of the platen.

When the emulsion has been dried for the appropriate length of time, dampers 8, 10 and 6 are closed and dampers 9, 5 and 7 are opened. Incubation air is led into the chamber through duct 3, past damper 7 into distribution manifold 12, across the emulsion and back through return manifold 26, past damper 5 to return duct 4.

After a prescribed period of passing incubating air over the emulsion, the pneumatic cylinders 16 are deactivated, the urging members 15 are retracted upward and the web is released.

The controlling means for regulating the timing and temperature of the process is typically a computer, although there is no reason, in principle, that control could not be provided by manual operation of dampers and valves that regulate the flows of air into the chamber and heat transfer medium into the platen.

The process control parameters are preferably predetermined in the light of the emulsion that is to be cured in each experiment, and stored in a computer where they can be accessed for each run. The computer is preferably preprogrammed to accept the input conditions for each stage in an operating cycle for each run to be performed, and to respond to this information by setting the process control variables to their programmed set points and maintaining them by appropriate process control commands.

The several steps of each process may be divided into predetermined timed segments, supplied to the computer for comparison with its internal clock to determine when each stage begins and ends so that the next stage can be entered into. Alternatively, the operator may program desired process end points, so that the computer will continue each stage until a desired processed state has been reached as indicated by appropriate process instrumentation responses. To accomplish these various purposes, the computer is preferably arranged to operate in three distinct modes.

In a first mode of operation, which can be initiated by the operator, the computer is programmed to maintain the chilling, drying, and incubating parameters at the last programmed conditions, or at a predetermined set of rest conditions. The internal timer of the computer is set to zero. In this mode of operation, arrangement may be made to actuate the computer by command from the keyboard to display data, generate reports, perform analyses, or to carry out any other programmed routines.

In a second mode, the computer is programmed to check its own functioning, and check to the functioning of the machine controls and associated process control and monitoring equipment. If a determination is made that something is malfunctioning, the computer alerts the operator. The computer in this mode reads an internal file listing the experimental conditions for the next active mode, and can be arranged to preset fluid flows or environmental parameters in the platen or chamber. If file conditions cannot be attained or do not meet preestablished criteria, the computer alerts the operator at the terminal. Once these functions are satisfactorily performed, an indication is preferably provided to the operator that operation to the active state can be initiated.

In a third mode, the operator's action initiating the active state starts the computer's internal timer and programmed operating sequence. The computer then reads a specified internal file to determine the experimental conditions to be met and proceeds to process the coated web accordingly. After the coated web has been processed, the computer places itself back into the first mode.

During the third or active control mode, the computer automatically responds to the preset series of operating commands, combined with the preprogrammed experimental conditions for each state and each programmed run. It interacts directly with the platen chill and heat controllers and with the air controllers to provide environmental conditions that meet the preprogrammed experimental specifications. In addition, it preferably records displays and stores specific process variables and on-line information for future use.

In general, each planned experimental curing of an emulsion has a complete set of preprogrammed operating specifications detailing the chilling, drying and incubating process conditions. The computer 38 which implements the control system is preferably of the type suitable for real time multitasking operation (e.g., the Hewlett Packard Company—9000 Series 360 or similar process control computer). Programming of the described preferred control process or other suitable alternatives is within the skill of those versed in the relevant art.

The sources of heat transfer medium for heating and cooling the platen are conventional and their provision is well known in the art.

Similarly, the means for delivering air of predetermined temperature, humidity and flow rate are conventional In a particular embodiment, ambient air is filtered, humidified and recirculated through ducts 1 and 2 and 3 and 4 by fans, humidifiers and heat exchangers in conventional air conditioning units 26 and 27. Flow is controlled by dampers 8, 9, and 10 and 5, 6, and 7. Final temperature control is added by conventional heat exchangers in ducts 1 and 3. Overall control of the dampers 5, 6, 7, 8, 9, and 10 and valves 28 and 29 is maintained in the preferred embodiment by a computer 38 operating through one or more pneumatic solenoid valves 36.

The apparatus of the invention may be free-standing or may be incorporated into a larger apparatus for the purpose of simulating or testing other aspects of a process relating to photographic emulsions in combination with its curing.

It is evident that the example of the apparatus which has been described by way of illustrating a preferred embodiment of the apparatus of the invention is not in any way limiting, and that various modifications may be made within the spirit and scope of the invention.

We claim:

1. An apparatus for curing photographic emulsions comprising:

(a) a single chamber having walls and a top integral therewith, a floor discontinuous with at least two of said walls; said chamber having provision for the ingress and egress of an airflow;

(b) said floor being in the form of a platen disposed so as to provide a channel for a photographic emulsion-coated web interposed between said platen and said chamber walls;

(c) means for heating and cooling said platen;

(d) means for urging said photographic emulsion-coated web into substantially uniform contact with said platen;

(e) means for delivering air of predetermined temperature, humidity and flow rate into said chamber; and (f) control means for regulating the temperature of said platen, and for regulating the delivery of said air of predetermined temperature, humidity and flow rate.

2. An apparatus according to claim 1 wherein said platen heating and cooling means comprises a passage within said platen through which a heat exchanging fluid is passed.

3. An apparatus according to claim 1 wherein said means for urging said photographic emulsion-coated web is a parallel pair of urging members of substantially the same width as the width of said platen; said members attached to pneumatic cylinders mounted on opposite walls of said chamber at points such that said members, when said pneumatic cylinders are activated, are displaced into contact with said web and said web is urged against said platen at opposite ends of the longer dimension of said platen; and further characterized in that the surface of said platen is planar in its shorter dimension and is an arc of a cylinder in its longer dimension.

4. An apparatus according to claim 1 wherein said controlling means comprise pneumatic valves controlled by a computer.

5. An apparatus according to claim 2 wherein said platen comprises a longitudinally arched, thermally conductive face plate, a gasket, and a thermally insulating support block.

* * * * *